United States Patent [19]

Strobush

[11] Patent Number: 4,833,994

[45] Date of Patent: May 30, 1989

[54] DUAL PURPOSE EXPLOSIVE LEAD FOR A PROJECTILE HAVING A SHAPED CHARGE WARHEAD

[75] Inventor: Victor H. Strobush, Bloomington, Minn.

[73] Assignee: Honeywell, Inc., Minneapolis, Minn.

[21] Appl. No.: 143,778

[22] Filed: Jan. 14, 1988

[51] Int. Cl.[4] ..... F42B 13/10

[52] U.S. Cl. ..... 102/476; 102/272; 102/500

[58] Field of Search ..... 102/473, 476, 306–310, 102/499, 500, 272, 204

[56] References Cited

U.S. PATENT DOCUMENTS

| | | | |
|---|---|---|---|
| 2,697,400 | 12/1954 | Liljegren | 102/476 |
| 2,741,180 | 4/1956 | Meister | 102/476 |
| 2,764,092 | 9/1956 | Massey | 102/476 |
| 3,416,644 | 12/1968 | Brothers | 102/56 |
| 3,750,582 | 8/1973 | Kintish et al. | 102/476 |
| 4,470,353 | 9/1984 | Fogal et al. | 102/476 |
| 4,574,702 | 3/1986 | Brandt | 102/476 |

FOREIGN PATENT DOCUMENTS

| | | | |
|---|---|---|---|
| 2460303 | 10/1978 | Fed. Rep. of Germany | 102/476 |
| 999974 | 2/1952 | France | 102/476 |
| 1002092 | 3/1952 | France | 102/476 |
| 1231003 | 9/1960 | France | 102/476 |

*Primary Examiner*—Harold J. Tudor

*Attorney, Agent, or Firm*—R. W. Jensen; E. W. Hughes

[57] ABSTRACT

A projectile 10 with a shaped charge warhead 27 and a nose mounted contact fuze 30. A precursor shaped charge 56 and liner 48 are mounted in the base 38 of fuze 30. When a target 64 is impacted by the projectile 10, a precursor shaped charge jet is produced by charge 56 and liner 48 which forms a passage 66 through fuze 30 substantially free of debris from the fuze 30 through which the warhead shaped charge jet 62 passes.

8 Claims, 1 Drawing Sheet

DUAL PURPOSE EXPLOSIVE LEAD FOR A PROJECTILE HAVING A SHAPED CHARGE WARHEAD

BACKGROUND OF THE INVENTION (1) Field of the Invention

This invention is in the field of munitions, the projectiles of which are provided with a shaped charge warhead, and more particularly to smaller caliber projectiles of such type with nose mounted contact fuzes which are fired from guns.

(2) Description of the Prior Art

Projectiles with shaped charge warheads produce a high velocity small diameter jet of molten metal derived from a metal liner defining the inner surfaces of the shaped charge. The shaped charge jet is produced by the detonation, or implosion, of the high explosive shaped charge surrounding the liner. For a shaped charged jet to achieve maximum penetration of the armor of a target struck by the projectile, the diameter of the jet should be minimized to maximize the density of the jet, and the velocity of the jet should also be maximized. By minimizing, or substantially eliminating redundant material, or debris, derived from a nose mounted fuze from the path of the shaped charge jet produced by a projectile's shaped charge warhead, the density and velocity of the jet are maximized as is its ability to penetrate armor.

With respect to smaller diameter, or caliber, projectiles having a shaped charge warhead and a nose mounted fuze, debris from the fuze present in the path of the warhead's shaped charge jet has a deleterious effect on the velocity and density of the warhead's jet. Such debris is a greater problem for smaller diameter projectiles because the ratio of the mass of the fuze relative to the mass of the liner and the shaped charge of the warhead is relatively high as compared with larger diameter projectiles.

Applicant's invention solves the problem of clearing, or removing, from the path of a warhead's shaped charge jet debris derived from an impact fuze mounted in the nose of a projectile to maximize the ability of the shaped charge jet to penetrate armor of a target.

PRIOR ART STATEMENT

The following patents are submitted under the provisions of 37 CFR 1.97(b), Brothers; U.S. Pat. No. 3,416,449, and Fogal et al. U.S. Pat. No. 4,470,353.

Brothers U.S. Pat. No. 3,416,449 discloses a fin stabilized anti-tank projectile, the warhead of which is provided with two shaped charges. Shaped charge 16 is positioned to the rear, or near the base, of projectile body 10 when compared with Brothers' second shaped charge 20. First shaped charge 16 is initiated by base fuze 14. Shaped charge 16 produces a first shaped charge jet that passes through a central opening, or nozzle 22, in second shaped charge 20. The jet produced by the functioning of charge 16 initiates charge 20 to produce a second shaped charge jet. Brothers first shaped charge jet functions to destroy any spacive armor, or protective covering, of the target. The function of the second jet is to destroy, or defeat, that portion of the target's main armor exposed by the first jet.

Fogal et al. U.S. Pat. No. 43,470,353, teaches an improved apparatus for initiating shaped charge 16 of projectile 10. Projectile 10 is provided with a conventional nose fuze 11. Charge 16 is initiated by spitback flier plate 20 which is accelerated to a high velocity by lead explosive 17 of fuze 11. Spitback flier plate 20 travels through liner 14 and neck 15 to strike and detonate booster pellet 22 which is located in the base of neck 15 in contact with the high explosive shaped charge 16 of the warhead. When booster pellet 22 detonates, it causes high explosive shaped charge 16 to detonate.

SUMMARY OF THE INVENTION

The present invention provides a projectile of a round of ammunition with a shaped charge warhead, which includes a shaped charge and a shaped charge liner about which the shaped charge is positioned. The projectile has a nose mounted fuze which includes a precursor shaped charge and precursor shaped charge liner positioned in the base of the fuze. The precursor charge is initiated by the fuze when the fuze is armed and strikes a target at substantially the same time as a spitback charge of the firing train is initiated. The spitback charge accelerates a spitback flier plate to a sufficiently high velocity to initiate the detonation of the shaped charge warhead by striking a booster pellet positioned in the neck portion of the shaped charge liner of the warhead.

The precursor charge when initiated acts on its associated precursor liner to produce a diffused, or noncoherent precursor jet. The precursor jet substantially clears debris from the nose mounted fuze, forward of the precursor charge from the path of the warhead's shaped charge jet. As a result, the warhead's shaped charge jet strikes, or impacts, the target with the diameter of the jet minimized and its velocity undiminished to optimize the jet's ability to penetrate the armor of a target impacted by the projectile.

It is therefore an object of this invention to optimize the ability of a shaped charge jet of a projectile provided with a shaped charge warhead and a nose mounted fuze to penetrate an impacted target.

It is another object of this invention to provide a projectile with a shaped charge warhead and a nose mounted impact fuze with a precursor shaped charge which clears debris derived primarily from the fuze from the path of the shaped charge jet produced by the warhead.

It is yet another object of this invention to provide a nose mounted fuze for a spin stabilized smaller diameter projectile having a shaped charge warhead with a precursor shaped charge mounted in the base of the nose fuze for clearing from the path of the jet produced by the shaped charge of the warhead debris from the fuze substantially at the time the warhead's shaped charge is detonated.

DESCRIPTION OF THE DRAWINGS

Other objects, features and advantages of the invention will be readily apparent from the following description of the preferred embodiment thereof taken in conjunction with the accompanying drawing although variations and modifications may be effected without departing from the spirit and scope of the novel concepts of the disclosure and in which.

DESCRIPTION OF THE PREFERRED EMBODIMENT

Figure 1:
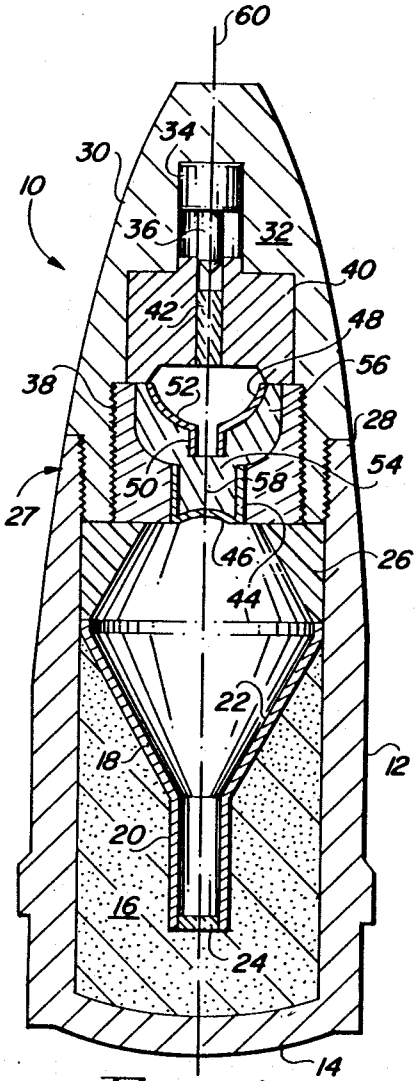
FIG. 1 of the drawing is a schematic longitudinal section of a projectile embodying the precursor shaped charge of the invention.

In FIG. 1, projectile 10 has a hollow body, or casing 12, the base 14 of which is an integral part of casing 12 and closes it. Positioned within body 12 is shaped charge 16 of a suitable high explosive material which is positioned around liner 18. Liner 18 which is made of a suitable metal, such as copper, has a hollow cylindrical neck 20 and a conical portion 22. Liner 18 provides the desired shape to shaped charge 16, particularly that portion of shaped charge 16 in contact with liner 18. Booster pellet 24 is positioned in the bottom of neck 20 in contact with charge 16. Shaped charge 16, liner 18, booster pellet 24 and retainer 26 constitute shaped charge warhead 27 of projectile 10. The structure and function of the elements of warhead 27 is substantially the same as equivalent elements described and illustrated in U.S. Pat. No. 4,470,353 issued to Fogal et al which is further described in the Prior Art Statement of this application.

Mounted in the forward portion 28 of projectile body 12 is nose fuze 30. Fuze 30 is provided with an ogive shaped body, or ogive, 32. In the preferred embodiment fuze 30 is threaded into body 12. In the forward portion of ogive 32 is positioned a piston assembly 34 which includes a firing pin 36. In the base of ogive 32 there is threadably mounted base 38. Between base 38 and piston assembly 34 is positioned fuze body holder 40. Located within holder 40 is lead initiator, or detonator, 42.

Located within base 38 is a hollow spitback cup member 44. The base of cup member 44, when separated from cup 44 constitutes spitback flier plate 46. The portion of fuze base 38 proximate body holder 40 is provided with precursor liner 48. Precursor liner 48 has an open substantially cylindrical neck, or tube, 50 and a substantially spherical portion 52. Base high explosive charge 54 fills spitback cup member 44 and that portion of charge 54 in contact with precursor liner 48 forms a precursor shaped charge 56. The portion of base charge 54 filling cup 44 is referred to as spitback charge 58.

Incorporating a precursor shaped charge 56 into the base 38 of nose fuze 30 is particularly effective in small caliber cased ammunition fired from a gun having a diameter ranging from 40 mm to 25 mm, for example. Weapon systems of air vehicles such as close support aircraft, both fixed winged and rotary winged for attacking armored vehicles such as personnel carriers and fortified fixed positions typically include rapid fire guns of this caliber. Ammunition of this type also has an anti-personnel capability since detonation of shaped charge 16 of warhead 27 breaks up the body 12 of projectile 10 into fragments, or shrapnel.

In operation, after projectile 10 is fired, the setback forces and centrifugal force to which the projectile is subjected, arm fuze 30. When fuze 30 is armed, the firing train between lead initiator 42 and shaped charge 16 is completed, and firing pin 36 is free to strike lead initiator 42. At any time after fuze 30 is armed that ogive 32 of fuze 30 impacts, or grazes, a target, firing pin 36 is driven by the crushing of the forward portion of ogive 232 into lead initiator 42. When lead initiator 42 is struck by firing pin 36, it functions, or detonates. Flame, hot gases, and shock waves are produced by the detonation of lead initiator 42.

Figure 3:
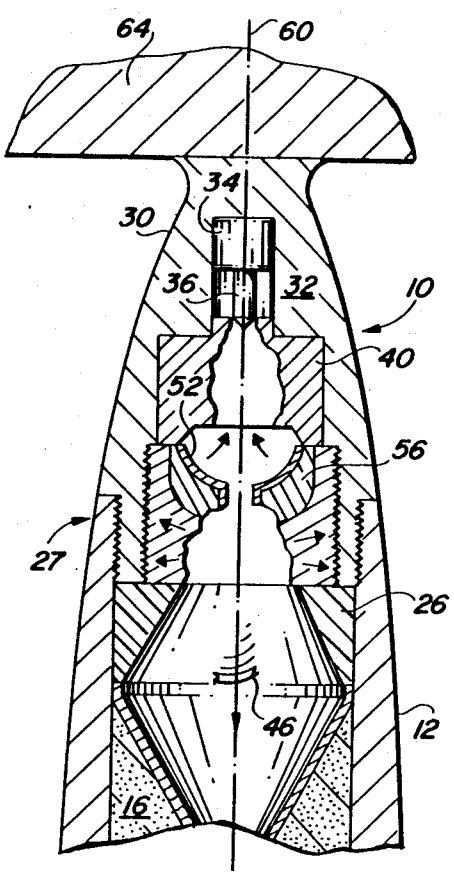

Detonation of initiator 42 causes the base charge 54 in base 38 to detonate. That portion of base charge 54 identified as spitback charge 58 when detonated separates the spitback flier plate 46 from spitback cup 44 and accelerates spitback plate 46 along axis 60 toward the booster pellet 24. That portion of base fuze 54 identified as precursor shaped charge 58 of base charge 54 is also concurrently initiated, or detonates, as illustrated in FIG. 3

Figure 4:
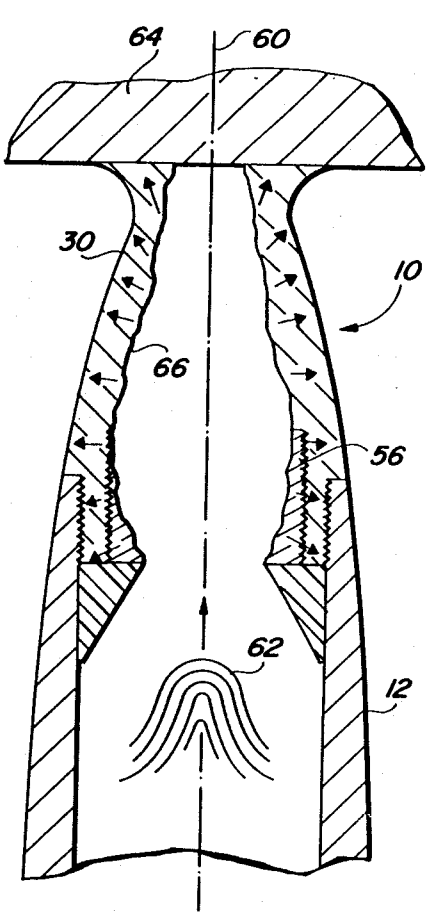
FIGS. 2, 3, and 4 illustrate operation of the invention.

Precursor liner 48 is shaped, or configured, to produce a relatively large diameter noncoherent jet which substantially clears away debris from fuze 30, debris derived from body holder 40, piston assembly 34 and ogive 32 from the path of the warhead shaped charge jet 63 produced by the detonation of shaped charge 16 acting on liner 18 as illustrated in FIG. 4.

Booster pellet 24 is detonated as the result of the spitback plate flier 46 striking pellet 24 with a sufficient amount of force to detonate it. Detonation of pellet 24 causes the shaped charge 16 to detonate. Charge 16 when detonated acts on liner 18 to produce warhead shaped charge jet 62 of warhead 27 which travels at a very high velocity forward along axis 60 toward ogive 32 of fuze 30.

The precursor shaped charge jet produced by precursor shaped charge 58 is produced a very short but finite time interval prior to shaped charge jet 62 being produced by the detonation of shaped charge 16. This period of time is long enough for the precursor jet to clear debris from the fuze from the path of the warhead jet along spin axis 60. Or, stated another way, warhead jet 62 is produced a very short interval of time or almost immediately, after, the precursor jet is produced.

Figure 2:
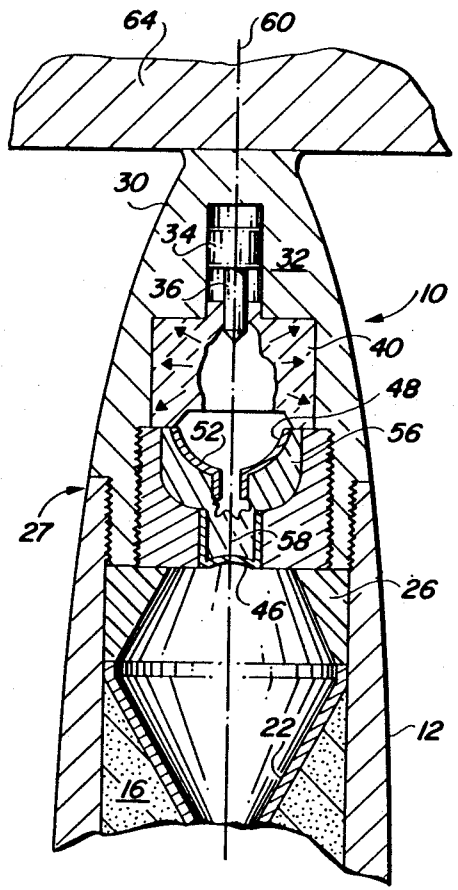

Referring to FIGS. 2, 3, and 4 which illustrates events that occur during the brief interval of time between when projectile 10, nose fuze 30 which includes a precursor shaped charge of this invention impacts target 64 and the shaped charge jet 62 of warhead 27 is produced. In FIG. 2, ogive 32 has just impacted target 64, firing pin 36 has been driven into lead initiator 42 which had detonated. An effect of the detonation of initiator 42 is that the force of the explosion expands the cavity in holder 40 in which initiator 42 is initially located.

A second effect of the detonation of initiator 42 is to initiate base charge 54 of base 38. Spitback charge 58 of base charge 54 separates spitback flier plate 46 from spitback cup member 44, and spitback flier plate 46 is driven toward booster pellet 24 as seen in FIG. 3. Precursor shaped charge 56 of base charge 54 and its liner 48 form a relatively large diameter noncoherent precursor shaped charge jet which is directed toward target 64 and which forms passage, or cavity, 66 substantially symmetrical with respect to axis 60 within fuze 30 as illustrated in FIG. 4 forward of precursor charge 58. Spitback charge 58 enlarges the opening in base 38 in which spitback cup member 44 is initially positioned. As a result, by the time warhead shaped charge jet 62 is produced as illustrated in FIG. 4, cavity 66 is formed and is substantially free and clear of debris derived from elements of fuze 30. As a result, warhead shaped charge jet 62 does not encounter any such debris prior to hitting target 64 which maximizes its ability to penetrate target 64.

In the preferred embodiment ogive 32, holder 40, and base 14 are made of aluminum. Firing pin piston assembly 34 can be made of aluminum, plastic or steel materials. Thus, the debris produced by the impact of nose fuze 30 with target 64 can include materials derived from any and all of these sources. In the preferred embodiment the liners 48 and 18 are made of copper and the high explosive material from which shaped charge 16 and the base charge 54 is made is PBXN-5.

From the foregoing it is seen that the precursor shaped charge of this invention which is positioned between the shaped charge of the warhead and a substantial portion of the nose fuze has the ability to substantially clear from the path of the warhead's shaped charge jet substantially all the debris produced as a result of the impact of the nose fuze with the target so that there is no material present from the nose fuze to interfere with or impede the warhead's shaped charge jet prior to its striking the target, thus maximizing the jet's ability to penetrate the target.

What is claimed is:

1. In a projectile 10 having a hollow body 12, a forward end 28, a base 14, a longitudinal axis 60, the projectile 10 being substantially symmetrical with respect to the the longitudinal axis 60, a shaped charge warhead 27 positioned in the body 12 for producing when initiated a warhead shaped charge jet 62 that is directed along and substantially coincides with the axis 60 of the body 12 toward the forward end 28 thereof, a nose fuze 30 including a firing pin 36, a lead initiator 42, and a fuze base 38 mounted in the forward end 28 of the hollow body 12, and a spitback charge 58 and spitback flier plate 46 mounted in the fuze base 38, the impact of the projectile 10 with an object 64 when the nose fuze 30 is armed driving the firing pin 36 into the lead initiator 42 to cause the lead initiator 42 to detonate, detonation of the lead initiator 42 initiating the spitback charge 58 to drive the spitback flier plate 46 into contact with a booster pellet 24 in contact with the shaped charge 16 of warhead 27 to initiate functioning of the shaped charge 16 to produce shaped charge jet 63: the improvements comprising:

precursor shaped charge means 48, 56 mounted in the base 38 of the nose fuze 30 for producing a precursor shaped charge jet directed along the longitudinal axis 60 away from base 14 when the spitback plate charge 58 is initiated by the detonation of the lead initiator 42, said precursor shaped charge jet forming a cavity 66 within nose fuze 30 which is substantially free of all the debris from the nose fuze and through which shaped charge jet 62 passes.

2. In a projectile 10 as defined in claim 1 in which the precursor shaped charge means 48, 56 includes a precursor shaped charge 56 and a precursor liner 48.

3. A dual purpose spin stabilized projectile 10 as defined in claim 2 in which the precursor liner 48 includes a substantially spherical portion 52 to produce the precursor shaped charge jet means which is a noncoherent jet.

4. In a projectile 10 as defined in claim 3 in which the diameter of projectile 10 is substantially in the range of from 25 to 40 millimeters.

5. A dual purpose spin stabilized projectile 10 comprising:

a hollow body 12 having a longitudinal axis 60, said longitudinal axis also being the spin axis of the body 12, a front end 28 and a base 14;

a high explosive shaped charge warhead 27 positioned in said hollow body 12;

a hollow substantially conical shaped charge liner 16, said liner 16 tapering toward the base 14 of the hollow body 12 to a neck portion 20;

a booster pellet 24 positioned within said neck portion 20 and in contact with shaped charge 16;

a retainer 26 for retaining shaped charge liner 18 and the high explosive shaped charge 16 within the body 12 of the projectile 10;

nose fuze 30 mounted in the front end 28 of the body 12, said nose fuze 30 including;

an ogive housing 32;

a firing pin 36, a lead initiator 42 and a fuze base 38 having a front portion and a rear portion mounted in said ogive 32;

a spitback flier plate 46 mounted in the rear portion of the fuze base 38;

a precursor shaped charge liner 48 mounted in the front portion of the fuze base 38; and a high explosive base charge 54 positioned between the flier plate 46 and the precursor liner 48, the base charge 54 being initiatied by detonation of the lead initiator 42, initiation of the base charge 54 producing precursor shaped charge jet means directed along longitudinal axis 60 away from base 14, said precursor shaped charge jet means forming a passage 66 through nose fuze 30 substantially symmetrical with the longitudinal axis 60 of body 12 which passage 66 is substantially free of debris from nose fuze 30, the initiation of base charge 54 also accelerating the spitback flier plate 46 toward booster pellet 24, said spitback flier plate 46 when it strike pellet 24 initiating shaped charge 16 to produce shaped charge jet 62 which travels along the axis 60 of the hollow body 12 toward the front end 28 of the body 12 and through passage 66 a very short time interval after the precursor shaped charge jet means is produced.

6. A dual purpose spin stabilized projectile 10 as defined in claim 5 in which lead initiator 42 is stab sensitive and is initiated when nose fuze 30 strike a target 64.

7. A dual purpose spin stabilized projectile 10 as defined in claim 6 in which the precursor shaped charge jet is produced by a substantially spherical portion of shaped charge liner 48.

8. A dual purpose spin stabilized projectile as defined in claim 7 in which the caliber of projectile 10 is in the range of from 25 to 40 millimeters.

* * * * *